United States Patent [19]

Davis

[11] 4,449,710

[45] May 22, 1984

[54] GAME BOARD, DIE AND REWARD DETERMINING GAME APPARATUS

[76] Inventor: Norman A. Davis, 2835 Rice St., Apt. 710, Minneapolis, Minn. 55113

[21] Appl. No.: 173,055

[22] Filed: Jul. 28, 1980

[51] Int. Cl.[3] ..... A63F 3/00

[52] U.S. Cl. ..... 273/249

[58] Field of Search ..... 273/243, 248, 249

[56] References Cited

U.S. PATENT DOCUMENTS

| | | | |
|---|---|---|---|
| 2,745,667 | 5/1956 | Graham et al. | 273/243 |
| 3,602,515 | 8/1971 | Seidman | 273/139 |
| 4,089,527 | 5/1978 | Roth | 273/249 |
| 4,216,594 | 8/1980 | Farley et al. | 273/249 |

FOREIGN PATENT DOCUMENTS

| | | | |
|---|---|---|---|
| 867150 | 5/1961 | United Kingdom | 273/249 |

*Primary Examiner*—Anton O. Oechsle

*Attorney, Agent, or Firm*—John W. Adams

[57] ABSTRACT

Game apparatus designed specifically for use as a teaching tool to reward participants for "correct" responses to life situation problems and including a game board having a winner's circle and a plurality of ramps leading radially into the circle, each of said ramps having a plurality of color coded spaces, said game apparatus also including a selection die having color coded surfaces thereon certain of which match the colors of said ramp spaces and certain of said die surface colors determining the action that participant should take. Said game apparatus also includes a play book having preselected life situation problems with multiple choice responses, choosing the "correct" response entitling the participant to a reward, said game apparatus also including a reward selection spinner with a reward selection board, each having matching indicia to determine the specific reward.

3 Claims, 4 Drawing Figures

GAME BOARD, DIE AND REWARD DETERMINING GAME APPARATUS

BACKGROUND OF THE INVENTION

In working with groups of people it has been found that learning is greatly enhanced by the use of rewards for proper behavior, thus teaching the pupil correct behavioral responses by means of granting rewards for correct answers to life situation problems. The game apparatus is particularly designed for use in such behavior modification therapy and is well adapted to (but not limited to) use with mentally retarded groups.

SUMMARY OF THE INVENTION

The present invention constitutes game apparatus which includes a game board having a winner's circle defined thereon and a plurality of ramps leading radially into the circle. Each of the ramps has a plurality of color coded spaces on which a player moves his playing piece. The game apparatus also includes a selection die having color coded surfaces thereon, certain of which match the colors of the ramp spaces and certain of the die surface colors determine the action that a player should take with respect to a play book which includes preselected life situation problems with multiple choice responses, whereby choosing the "correct" response entitles the player to a reward.

DESCRIPTION OF SPECIFIC EMBODYMENT DISCLOSED

Figure 1:
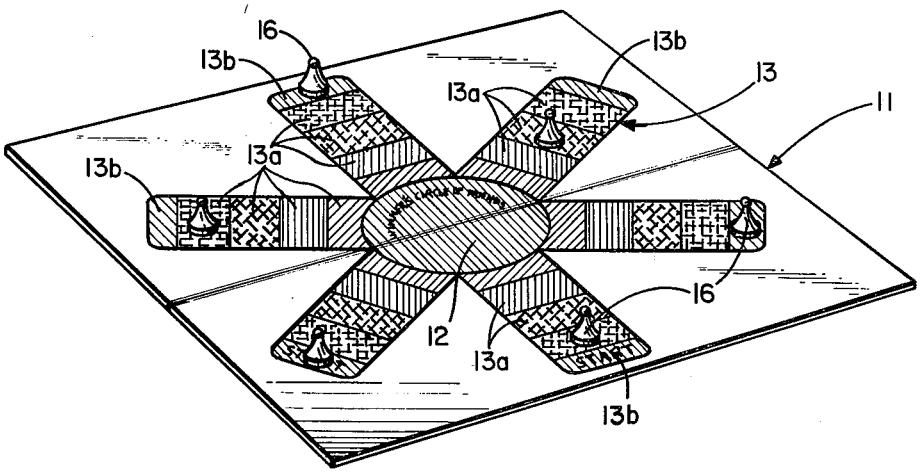
FIG. 1 is a perspective view of a playing board embodying the invention.

A game board 11 as best shown in FIG. 1, and includes a winner's circle 12 in the center portion thereof with a plurality of player ramps 13 extending radially outwardly from the circle. Each ramp is divided into a plurality of color coded spaces **13*a* and a starting space 13*b*** at the end of each ramp remote from said winner's circle.

Figure 4:
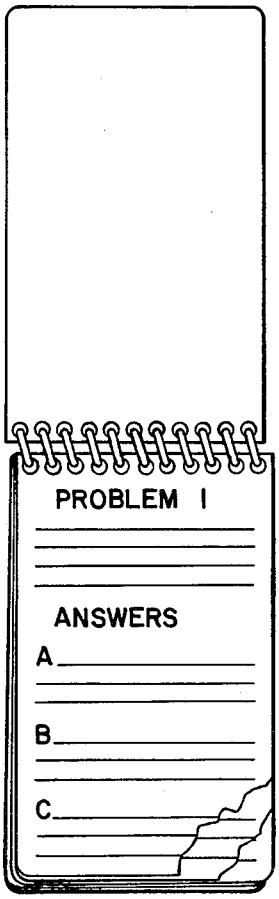
FIG. 4 is a top plan view of a typical page in the playbook.
Figure 2:
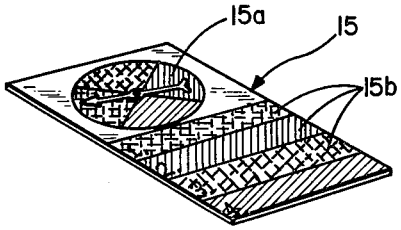
FIG. 2 is a perspective view of a reward selection board.
Figure 3:
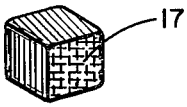
FIG. 3 is a perspective view of a selection die.

A life situation problem book, FIG. 4, contains a number of preselected problems each having multiple choice responses to said problems. A reward selection board 15 is also provided which includes a selection spinner **15*a*** and a plurality of identified rewards to be selected by the spinner.

Each player selects his playing piece 16 and places it on the starting space at the end of one of the ramps 13. Players then take turns throwing the die, each surface of which is color coded to determine the action to be taken by the player: Certain of the colored die surfaces respectively match the colors on the ramp spaces and other die surfaces are color coded to indicate the action the player may take. For example if the color that comes up on the die is green, the player will then be entitled to attempt to solve one of the multiple choice life situation problems contained in the problem book. Also if the color on the die corresponds to the color of the next space on that player's ramp, the player may attempt to solve the problem in the problem book. If the die comes up red, the player merely loses his turn and passes the die to the next player, and if the die comes up white, the player then has a chance to spin the spinner on the reward board and to receive a free reward but not move his playing piece.

If the player chooses the correct response to the selected life situation problem in problem book he is then entitled to move his playing piece one space toward the winner's circle and to spin the reward spinner to determine his reward for his "correct" response. The reward selection board 15 has a plurality of color coded selection segments **15*a* and a similar number of designated erasable reward identification spaces 15*b* respectively color coded similarly to the selection segments 15*a***.

It will be seen that this game provides an excellent teaching tool which combines the combination of competitive chance and the skill and intelligence testing and rewards for the players.

What is claimed is:

1. Game apparatus comprising, a. a game board including (1) a winner's circle (2) a plurality of player ramps extending radially of said circle, each ramp having a plurality of color coded spaces with (3) a starting space at the end of each ramp remote from the circle, b. a playing piece for each player initially placed on the starting space of one of the ramps, c. a playbook having a plurality of life situation problems set forth therein with a plurality of multiple choice responses to be selected by the player, and d. a selection die having color coded surfaces thereon to provide the means for determining which of a plurality of different actions a player should take, certain of said die colors corresponding to the colors of the ramp spaces, at least one other die surface having a color which is different from the die colors corresponding to the ramp space colors, when the die turns up the color on the next ramp space toward the winner's circle from the ramp space on which the player's playing piece resides, the player moves his piece onto said next ramp space, when the die turns up said different color, the player is directed to answer a problem in the playbook, by means of which said player may make a "correct" response which entitles him to move his playing piece one space on the ramp toward the winner's circle, each player reaching the winner's circle receiving a reward.

2. The structure set forth in claim 1, and a selection spinner having color selection indicia and a reward selection board including a plurality of rewards respectively having matching indicia to the respective spinner indicia, another surface of said selection die having another differentiating color which entitles the player to spin the selection spinner whereby matching the color indicia of the spinner with the color indicia of the reward selection board determines the specific reward awarded to that player.

3. The structure set forth in claim 2, and said reward selection board including a plurality of reward spaces provided with said matching color indicia having associated reward identifying indicia to respectively indicate a number of different rewards identifiable by the spinner and means for permitting the reward identifying indicia on said selection board to be erased to provide blank spaces to be filled in as desired.

* * * * *